US006443089B1

(12) United States Patent
Goucher et al.

(10) Patent No.: US 6,443,089 B1
(45) Date of Patent: Sep. 3, 2002

(54) INFLATABLE HIP GRIP AND SEAT

(76) Inventors: Tyler R. Goucher, 9110 Kelly Dr., Huntsville, UT (US) 84317; Lance F. Gunnell, 2908 W. 5700 South, Wellsville, UT (US) 84339; Gary K. Goucher, 6020 Sharon Cir., Ogden, UT (US) 84403

( * ) Notice: Subject to any disclaimer, the term of this patent is extended or adjusted under 35 U.S.C. 154(b) by 0 days.

(21) Appl. No.: 09/790,971

(22) Filed: Feb. 22, 2001

Related U.S. Application Data

(60) Provisional application No. 60/199,514, filed on Apr. 25, 2000.

(51) Int. Cl.[7] ..... B63B 35/71
(52) U.S. Cl. ..... 114/347; 114/345; 114/363
(58) Field of Search ..... 114/363, 347, 114/345; 441/91

(56) References Cited

U.S. PATENT DOCUMENTS 2,094,499 A * 9/1937 Scavo ..... 417/437
4,750,447 A * 6/1988 Spinosa et al. ..... 114/345
5,671,694 A * 9/1997 Schoettle ..... 114/347

FOREIGN PATENT DOCUMENTS

GB 2 331 235 * 5/1999

OTHER PUBLICATIONS

HipGrips; Radical Gear; pp. 1–3.
TheBreathing Tube; Radical Gear; pp. 1–3.

* cited by examiner

*Primary Examiner*—Sherman Basinger
(74) *Attorney, Agent, or Firm*—Madson & Metcalf

(57) ABSTRACT

A device for insertion into the cockpit of a small boat such as a kayak or canoe is presented. The device is a hip grip designed to be positioned within the cockpit of the boat and retain the hip portion of a user of the boat. The device has an inflatable bladder which can be fastened inside the cockpit on an interior wall by a fastener. An inflator is provided to infuse an inflation material into the bladder. The inflation material is retained within the bladder by a retention valve. The inflated bladder exerts a pressure on the hip portion of a user seated within the cockpit.

65 Claims, 5 Drawing Sheets

INFLATABLE HIP GRIP AND SEAT

The application is related to and claims priority from U.S. Provisional Patent Application No. 60/199514, filed Apr. 25, 2000 by Tyler R. Goucher and entitled Kinetic, Adjustable, Inflatable, Stabilizing, Contouring Hip Pad and Seat Combination System for White Water Kayaks.

BACKGROUND OF THE INVENTION

1. The Field of the Invention

The present invention relates to devices for use in boating sports. More specifically, the present invention relates to inventive inflatable hip grip and seat for insertion into a cockpit of a boat.

2. The Relevant Technology

Kayaking is a growing sport in the United States and throughout the world. There are a number of different types of kayaking and the boats and paddles associated therewith are designed for the particular type of activity engaged in. Thus, there are both calm water kayaks and white water kayaks along with sea or ocean kayak. For centuries, Eskimos have paddled Arctic waterways to hunt and fish in kayaks, a type of canoe built from skins stretched over a frame. Today's high-tech versions of the kayak, made from plastic, Kevlar and fiberglass, are still decked with a cockpit for the rider, who propels the boat with a double-bladed paddle.

The sport of kayaking is growing rapidly in popularity. It is believed to be second only to snowboarding in growth. Driving that growth is a recent revolution in hull design that has made doing tricks, such as wave surfing, squirts and spins, much easier. There are an estimated 1.3 million white water kayakers in the United States, 400,000 of whom can be considered "enthusiasts." One of the reasons for the increasing popularity of the sport is that a kayaker can experience solitude and wilderness on the one hand and excitement on the other.

Recent developments in kayaks has fueled the increased interest in the sport. In some instances, kayak builders have followed innovations in surfboards to come up with boats that "plane," riding on top of the water instead of in the water.

As kayaks have improved and developed, additional sports and activities are possible. Where traditional kayakers simply traveled a waterway, modern kayakers maneuver and perform tricks to improve and demonstrate their skills. To promote these types of activities, kayak rodeos are springing up around the country. Many of today's kayaks are specifically designed to be used in rodeos. These boats are generally small and sharply angled. These boats, however, are not ideally suited for river running in that they are too slow and do not track well. Thus, "park and play" is a growing phenomenon, while down-river running is declining in popularity. This marks a radical departure from the roots of these sports, which were born from the need to get from one place to another. Thus, innovation is allowing more people to enjoy kayaking and to do different things on a river.

Generally, the kayakers sit in an opening in the shell of the kayak. This opening is known as the cockpit. Once the kayaker is seated within the cockpit, a skirt is often placed over the cockpit to prevent the interior of the kayak from filling with water in the event of a roll. In modem kayaks, a contoured seat is generally provided within the cockpit to provide the kayaker with a more comfortable ride. The seat may be supplied with a pad for an even more comfortable seat.

An important element that is also located within the cockpit is the hip grip. The hip grips are generally made from a foam material that is fastened on the sides of the cockpit. The hip grips are positioned within the cockpit such that the hips of a seated kayaker are engaged by the hip grips. Thus, the hip grips connect the kayak to the boater's hips transferring the kayaker's body movements directly to the kayak. This connection increases the maneuverability of the kayak.

There are only a few sizes and configurations of hip grips currently available. The hip grips are generally wedge-shaped and made of a rigid, hardened foam material. Because the hip grips are available in only a few sizes, they must be customized to fit each user. A user will purchase a generically sized hip grip and then file and sand it to custom fit the intended user. The rigid wedge shape of most hip grips may cause pain and discomfort after a long run or frequent kayaking. This pain is caused because the rigid hip grips push into the hip contacting pressure points and causing bone compression.

Often, the customized hip grips are permanently glued to the inside of the cockpit with a waterproof glue. When kayaks are used by more than one user, the users may have vastly different sizes and body types. Because of the increased popularity of the sport, many kayaks are available for rent. Moreover, kayak equipment can be expensive and is frequently shared among family members or friends. The glued-in hip grips are not readily customizable to each potential user of the kayak.

Even among kayakers of the same general size, the fit of a hip grip is very personal. One kayaker may desire that his hip grips fit more snugly than another kayaker. Additionally, a kayaker may desire a different fit depending on the type of kayaking activity and his level of fatigue. When a kayaker is preforming tricks, it may be desirable to have a tight fitting hip grip to have increased control over the kayak. When a kayaker is on a longer trip such as a river run, a tight hip grip may be uncomfortable. Also, a kayaker may prefer a tight fit at the beginning of a run and a looser fit as he becomes fatigued. The presently available hip grips are not adjustable and do not allow for a user to change the fit for his individual preferences.

The popularity of water sports is not only limited to kayaking. Other types of small boats such as canoes, rafts, and row boats are very popular with recreationalists. These small boats are frequently used in the same rivers, lakes, and other waterways as kayaks. For example, boaters using canoes, rafts, and row boats run white water rapids. Because of the danger associated with white water running, these boaters, like kayakers, must have control of their boats at all times. A significant element of controlling a boat is the amount and strength of the contact between the boater and the boat. There is currently a lack of devices that can be inserted into these small boats to aid the boater with control of the boat.

The sport of kayaking could be improved by providing a hip grip that could be readily accommodate multiple users. It would be an additional improvement if the hip grip were adjustable to provide for the changing preferences of a kayaker. Another advancement would be made if the hip grip were easily removed from a kayak. It would to be a further advancement if the hip grip provided some give to prevent the pain generally associated with prolonged contact with a hip grip. It would be an additional advancement if the hip grip could be used to retain the hip portion of a boater in a small boat such as a canoe, a row boat, or a raft.

These and other advantages and improvements are provided by the present invention.

BRIEF SUMMARY OF THE INVENTION

The present invention relates to novel hip grip for insertion into the cockpit of a boat such as a kayak, canoe or other small water craft. The hip grip has an inflatable bladder that may be positioned within the cockpit on an interior wall. The inflatable bladder may be positioned to retain the hip portion of a user.

An inflator may be provided to inflate the bladder. The inflator may be permanently connected to the bladder or may be attached to the bladder to inflate the bladder and disconnected from the bladder after the bladder is inflated.

When the inflator is connected to the bladder, the inflator is in fluid communication with the bladder. The inflator inflates the bladder infusing an inflation material into the bladder. Such inflation materials may include, but are not limited to a gas, a liquid, and a gel. The presently preferred inflation material is air because it is safe as easily manipulated. In addition, air within the bladders can serve as an emergency breathing supply to the kayaker in the event of capsizing. Moreover, when the inflation material is air or other inflation material that is less dense than water, the hip grip may also be less dense than water and additional buoyancy to the boat.

An inflated bladder exerts a pressure on the hip portion of a user seated within the cockpit, thus connecting the user to the boat. Because the boater is connected to the boat, the boater's movements are transferred to the boat. A boater has greater control over the boat with a properly inflated hip grip with a conventional hip grip. This extra control allows the boater to more easily perform tricks and maneuver to avoid danger.

Once the inflation material is infused into the bladder, a retention valve retains to retain the inflation material within the bladder. The retention valve may be a one way valve that prevents the inflation material from flowing back out of the bladder. Another valve may be provided to allow for the removal of the inflation material from the bladder. Such a release valve is in fluid communication allowing a user to release inflation material from the bladder. The pressure of the inflatable hip grip on a user's hips can be adjusted by infusing or releasing inflation material from the bladder. The retention valve and release valve may be combined into one valve which can alternately be opened or closed.

A fastener may be provided to secure the hip grip within the cockpit. Such fasteners may include permanent fasteners such as adhesives, screws, bolts, brads, and rivets. Additionally, the fasteners may allow for the easy removal and replacement of the hip grips. Such fasteners may include hook and loop fabric, snaps, tape, tethers, zippers, and the like.

An inflation tube may be provided to allow for the inflation and deflation of the bladder remotely from the bladder. The inflation tube is advantageous where the inflator is positioned or secured to the thigh portion of a user. With the inflator on the thigh of the user, the bladder may be inflated by a user activating the inflator by pressing down on the skirt covering the cockpit.

Several types of inflators can be used when the inflation material is air. For example, the inflator may be a mouthpiece configured to be connected to the bladder. When a user blows into the mouthpiece, the bladder is inflated with air. The air in the bladder may also serve as secondary air for a boater trapped beneath the water. Other inflators may include a vessel of compressed air. The vessel may be attached to the bladder and activated. The compressed air then exits the vessel and inflates the bladder.

Another inflator that may be used to infuse inflation material into the bladder is a hand pump. Such pumps may be compressed by hand and infuse air or other fluids into the bladder. A hand pump can be connected to a an inflation tube to position the hand pump distantly from the bladder. With the hand pump positioned away from the bladder, the hand pump can be accessed by the user to inflate the bladder after the user is seated within the cockpit of the boat.

The inflatable hip grips may also be contoured to accommodate a user. Channels may be provided within the bladder for receiving the inflation material. The channels create one or more chambers within the bladder. The channels may be configured to present a larger chamber near the top of the bladder and a smaller chamber near the bottom of the bladder. In this manner the inflatable hip grip may have the wedge shape of conventional hip grips.

A sleeve may also be provided to be place over the inflatable bladder. Such a sleeve may be constructed of a material that is flexible and able to withstand frequent immersions in water. The sleeve protects the bladders from punctures and premature wear. The sleeve may be configured to be removed and exchanged with another sleeve. The exchangeable sleeve can prolong the life of the hip grip system, and allow a user to change the color of the hip grip to match for example his boat.

The inflatable hip grip may also be attached to a seat cushion. In this manner additional padding may be provided for the user. The seat cushion may be configured to pad either the back or the posterior or the back and the posterior of the boater. Generally, the seat cushion may be attached to the seat of the boat with a fastener such as adhesives, screws, bolts, brads, rivets, hook and loop fabric, snaps, tape, tethers, zippers, and the like. Because the hip grip is attached to the seat cushion, the attaching the cushion to the seat will more securely connect the hip grip system within the cockpit of the boat may also help to more securely connect the user with his boat. This added connection can allow the boater to have more control over the boat.

A pair of inflatable bladders described above may be jointly inserted within the cockpit of a boat. With two inflatable bladders, the user's hips are both secured to the boat. Where two bladders are used, the bladders may be fluidly connected to each other so that the infusion or release of inflation material from one bladder will change the amount of inflation material in the other bladder. Alternatively, the bladders may be fluidly isolated from each other so that a change in the amount of inflation material in one bladder will cause no change in the other bladder.

The invention also relates to a kayak seat to be placed within a kayak cockpit. The seat may have an inflatable hip grip as described above attached to a cushion. The seat may be secured within the cockpit by a fastener. Such fasteners may be hook and loop fabric, adhesives, snaps, tape, tethers, zippers, screws, bolts, brads, rivets and the like.

The novel inflatable hip grip of the present invention overcome many of the deficiencies of the current hip grip. The hip grip may be inflated and deflated to accommodate different users. Additionally, a user may change the pressure in the hip grip as needed for the user's changing preferences. The hip grip may also be removed, replaced, and exchanged easily. The inflatable hip grip may also reduce the pain associated with the hip grip compressing the bones and pressure points of a user.

Thus, the present invention provides improvements to hip grips and for use in small water craft and these and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE PREFERRED EMBODIMENTS

Figure 1:
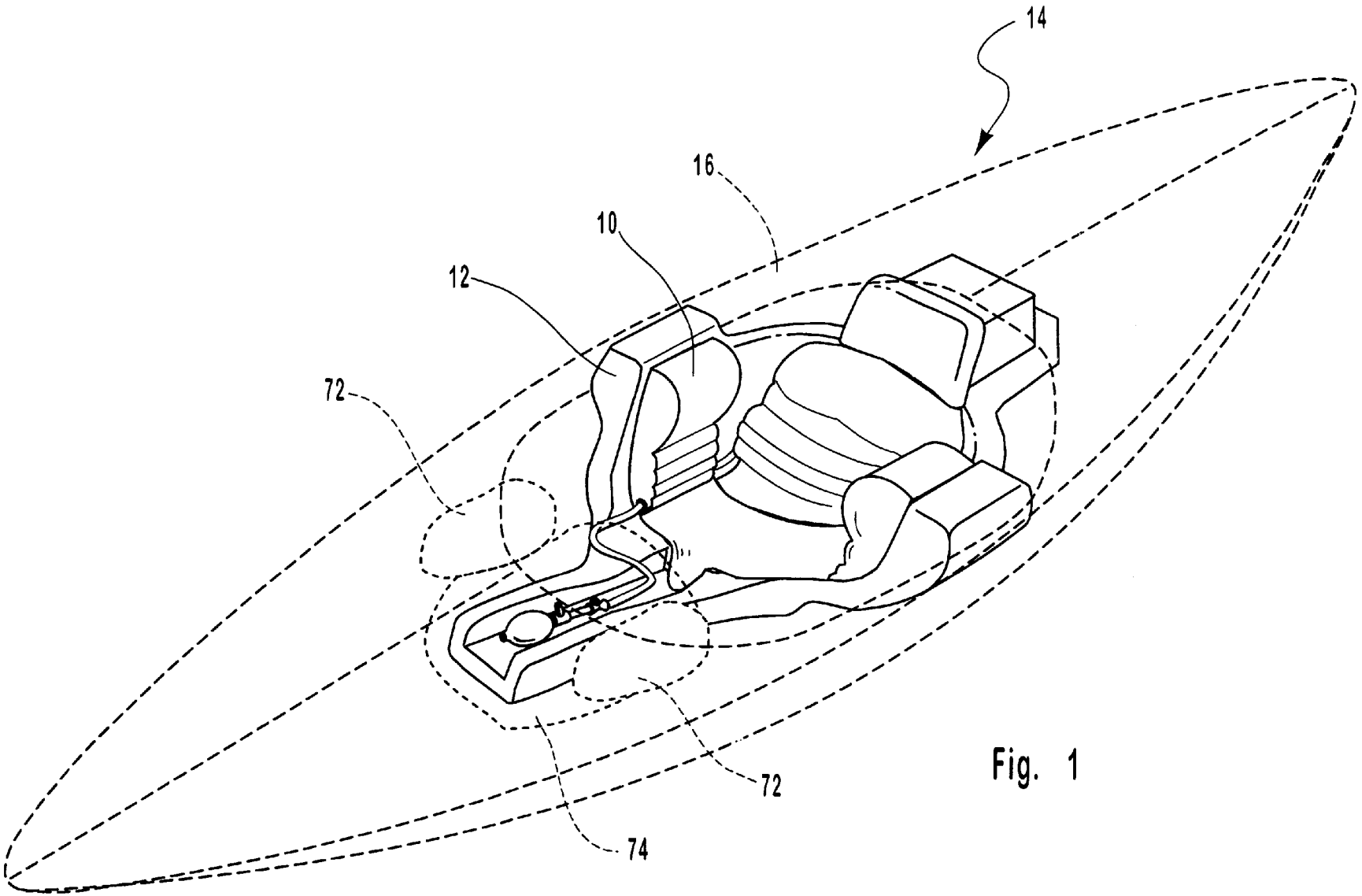
FIG. 1 is a perspective drawing illustrating one embodiment of the hip grip of the present invention positioned within the cockpit of a boat.

The present invention can be better understood with reference to the drawings where like parts are designated with like numerals throughout. As illustrated in FIG. 1, the present invention relates to a hip grip 10 for insertion into the cockpit 12 of a boat 14. As discussed above, many boating sports, especially the sport of kayaking have advanced rapidly. Advancements in kayak construction have opened new opportunities for kayaking and have diversified the types of activities that can be undertaken in a kayak. As a result, there is a need in the art for improvements to the conventional hip grip to further facilitate advancement of these boating sports. The present invention is related to providing such advancements in the design and construction of hip grips.

FIG. 1 is a perspective view of a boat 14 having a hip grip 10 of the present invention secured within the cockpit 12. The hip grip 10 is configured to be inserted within the cockpit 12 and mounted to an interior wall 16. The hip grip 10 exerts a pressure against the hip of a user seated within the cockpit 12. This pressure connects the user to the boat 14 and transfers the movements of the user to the boat 14. This transfer of movement gives the user more control over the boat 14. Thus, the user can steer and maneuver the boat more easily.

Inflatable knee grips 72 can be configured to be connected to the hip grip system 10. The knee grips 72, allow a kayaker to exert a pressure against the sides of the boat 14 while minimizing any pain that might result. This pressure also allows the kayaker to have greater control of the boat 14. The invention also provides for an inflatable ballast 74 which can be positioned near the center of the cockpit 14, between the legs of a kayaker. The hip grip 10, knee grips 72, and the inflatable ballast 74 can be in fluid communication with each other. In certain embodiments, the hip grip system 10 is inflated with air. The air contained in the hip grip 10, knee grip 72, and the ballast 74 can serve as secondary air in an emergency situation.

Figure 2:
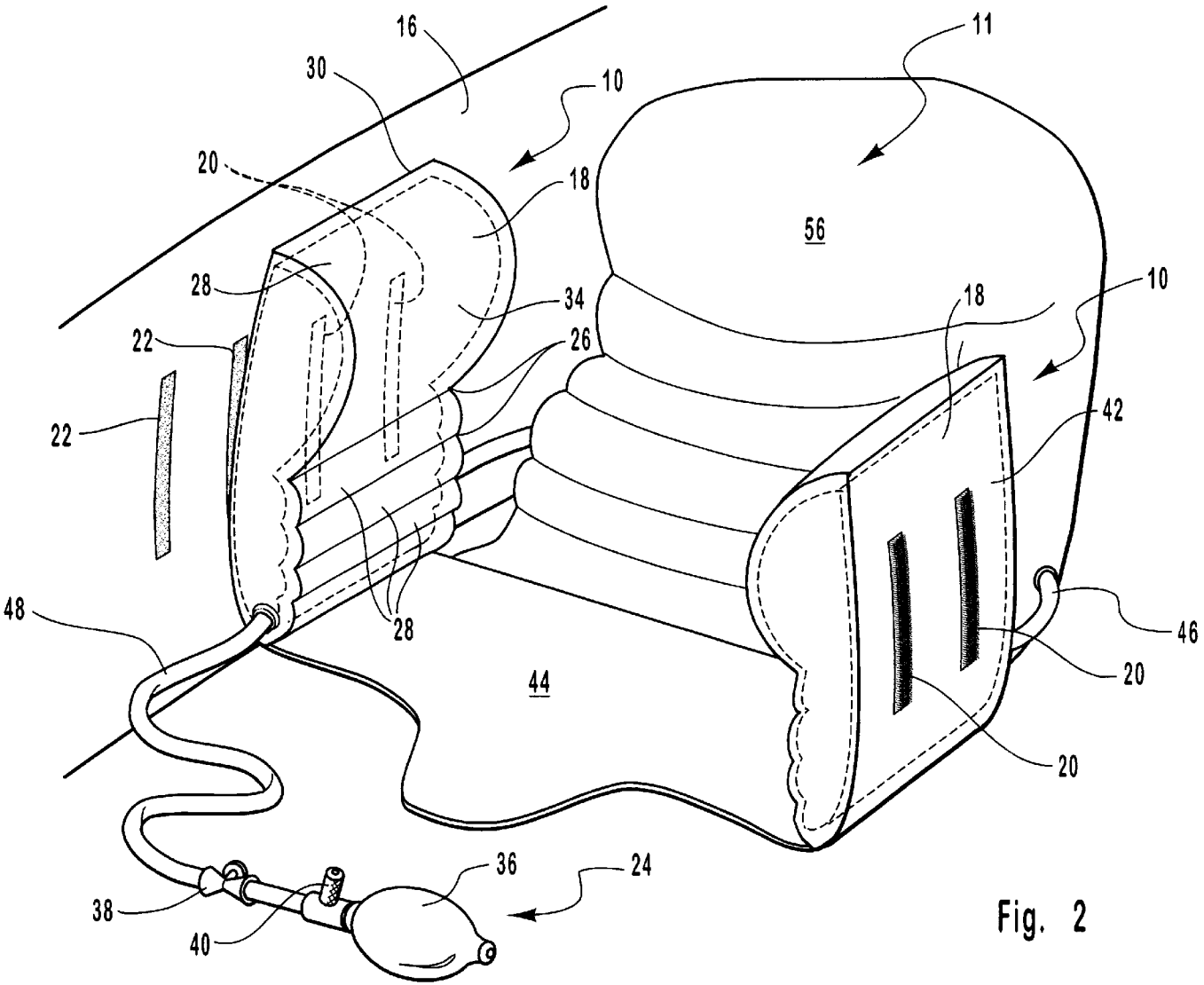
FIG. 2 is a perspective view of a one embodiment of the hip grip with an attached hand pump.

Referring to FIG. 2, the hip grip 10 includes an inflatable bladder 18 which is configured to be secured to cockpit wall 16. Bladder 18 is secured to the wall 16 by a fastener 20. The fastener 20 may be configured to permanently attached the hip grip 10 to the boat 14, or may provide for the ready removal and replacement of the hip grip 10. Such permanent fasteners 20 may include, but are not limited to of adhesives, screws, bolts, brads, and rivets. Other fasteners 20 will allow for the removal of the hip grip 10 from the boat. Such removable fasteners 20 may include snaps, tape, tethers, zippers, and hook and loop fabric.

Kayakers and other boaters often have more than one boat depending on the type of boating activity. For example, a boater may have one kayak for performing tricks in a river and a second for ocean trips. The hip grip system 10 with a removable fastener 20 will allow the boater to transfer the hip grip system 10 between boats. In the embodiment of FIG. 2, hook and loop fabric strips 20, 22 are attached to the hip grip 10 and cockpit wall 16 respectively. When the hook and loop fabric strips 20, 22 are pressed together, a bond is formed that secures the hip grips 10 to the cockpit wall 16. The hip grip 10 can be removed by pulling the hook and loop fabric strips 20, 22 apart.

The bladders 18 can be covered by a sleeve 42. The sleeve 42 protects the bladder 18 from puncture and abrasive wear which can cause the bladder to leak. The sleeves 42 can be constructed of fabric materials which withstand the corrosive effects of frequent immersion in water. Such materials may include neoprene or other rubberized fabrics. The sleeves 42 can be sewn over the bladders 18. Alternatively, the sleeves 42 may be sewn on one or more sides and slipped over the bladders 18. Less permanent fastening methods such as hook and loop fabric, snaps, zippers, and lacing may be used to complete the coupling of the sleeves 42 to the bladders 18. With a removable sleeve 42, the hip grip 10 may be supplied with sleeves 42 of different colors and textures allowing for a user to equip the boat 10 with the desired look.

The bladders 18 can be inflated by the infusion of inflation material from an inflator 24. The inflation material expands the bladders 24. The inflated bladders 24 will exert a pressure on the hip portion of a boater seated within the boat 14. The bladders 18 are preferably constructed of a water and air tight material to prevent leakage of the inflation material. Materials such as elastomeric polymers, rubber, latex, and the like may be sufficiently leak proof. Additionally, it may also be preferable for the bladders 18 to have some elasticity to allow the bladders 18 to stretch to accommodate different volumes of inflation material.

The inflation material is retained in the bladder by a retention valve 38. The retention valve 38 can be a one way retention valve that allows the fluid to only flow into the bladder 18 and prevents the release of the fluid from the bladder 18. With such a one way retention valve 38, the bladder 18 may be permanently inflated by a user or during manufacture.

Alternatively, the inflatable hip grip 10 may have a release valve 40. The release valve 40 corresponds to the retention valve 38. Thus the retention valve 38 may retain the inflation material within the bladder 18 when closed and also be configured to release the inflation material when opened. The release valve 40 can also be separate from the retention valve 38; a user would open the release valve 40 to expel inflation material from the bladder 18.

When the hip grip 10 is equipped with a release valve 40, the hip grip may be easily adjusted to accommodate the needs of different boaters. If a boater prefers that the hip grips 10 fit snugly on short active runs, additional inflation material can be infused into the bladders 18. Alternatively, if the boater prefers a looser fit on long river or ocean runs, the release valve 40 may be opened to decrease the pressure within the bladder 18. The inflatable hip grip 10 can also accommodate boat rental facilities and other joint users of kayaks by adjusting the amount of inflation material within the bladder 18.

Generally, the hip grip 10 will have a wedge shape with a bulge 34 located near the top 30 of the bladder 18. This wedge shape allows the hip grip 10 to be contoured to the shape of the user's hip. A series of channels 26 may can be fashioned in the bladder 18 to create one or more chambers 28. Each chamber 28 is configured to contain a volume of inflation material. The chambers 28 near the top 30 of the bladder 18 are configured to contain a larger amount of fluid than the chambers 28 near the bottom 32 of the bladder 18. This difference in chamber 28 capacity, creates a bulge 34 near the top 30 of the bladder 18.

The inflation material can be a gas, a liquid, or a gel. Each of the alternative inflation materials have different advantages. A liquid or gel inflation material may provide for a more comfortable fit because of its more viscus nature and more difficult flow among the chambers. Often kayaks are used in cold water. A liquid or gel may also be heated prior to infusion by the inflator 24 to allow for soothing heat on the boater's hips.

Gas inflation materials also have qualities that make them advantageous inflation materials. For example, gasses are generally less dense than water. Thus, a hip grip 10 inflated with a gas will probably be less dense than water. If the boat develops a leak, is capsized, or the like, the gas inflated hip grip 10 will add to the boat 14 and prevent it from sinking.

Another advantage of a gas inflatable hip grip 10 is the cost and availability of gases. For example, in the embodiment of FIG. 2, the inflator 24 is a hand pump 36. When a user manually depresses the hand pump 36, a gas such as air is infused into the bladder 18. Because air is freely available to a boater, air can be added or removed from the bladder at any time.

The inflator 24 may also be permanently attached to the hip grip 10 or detachable. The permanent inflator 24 allows the user to inflate the bladder 18 before entering the boat and while boating. The attached inflator 24 prevents the inflator 24 from being lost. Alternatively, a detachable inflator 24 may also be advantageous. With a detachable inflator 24, the bladders 24 can be inflated, and the inflator 24 removed from the hip grip 10. Such a detachable inflator 24 will allow the bladder 18 to be inflated and the possibly cumbersome inflator 24 to be removed from the hip grip 10. The cost of the hip grip 10 can also be reduced by a detachable inflator 24. The hip grip 10 can be inflated at the factory or by a retailer to custom fit the user without the need of selling an inflator to the consumer.

Generally, two or more bladders 18 will be used with the hip grip 10. The two or more bladders can be fluidly isolated from each other such that a change in the amount of inflation material on one bladder 18 will not cause a change in the amount of inflation material in the second bladder 18. This configuration may be advantageous when a user prefers to have the hip grip 10 on one side of his body harder or softer than the other hip grip 10.

Alternatively, the bladders 18 can be fluidly connected such that a change in the amount of inflation material in one bladder will cause a change in the amount of inflation material in the other. A hose 46 can connect the bladders 28 allowing for the flow of inflation material through the hose 46 and between the bladders. This configuration may allow for more rapid inflation of the bladders 18 and equal pressure in the bladders 18.

An inflation tube 48 can be provided to allow for the inflation of the bladders 18 by an inflator 24 positioned at somewhat of a distance from the bladders 18. With the inflator 24 positioned distantly from the bladders 18, the user has easier access to the inflator 24 while seated within the cockpit 12. This allows a user to add or remove inflation material from the bladders 18 while boating.

A seat cushion 44 may be secured to the hip grips 10, to provide a seat 11 which can be inserted into the cockpit 12. The cushion 44 will add additional padding and make a boater more comfortable when seated in the boat 14. The seat cushion 44 can be secured to the seat of the boat by a fastener. When the seat cushion 44 and the hip grips 10 are both attached to the boater's hips will be securely held in place by the inflated bladders 18. The boater's control of the boat will also be increased because his movements can be transferred to the boat through the seat cushion 44 and hip grips 18.

Additionally, the seat 11 may have a back pad 56. The back pad 56 can be a constructed of foam padding or configured to be inflated with the inflation material of the hip grip system 10. In such configurations, the hip grip system 10 is connected to the inflatable back pad 56 through hoses 46. Like the hip grip 10, the back pad 56 can be inflated with a liquid, a gel, or with air.

Figure 3:
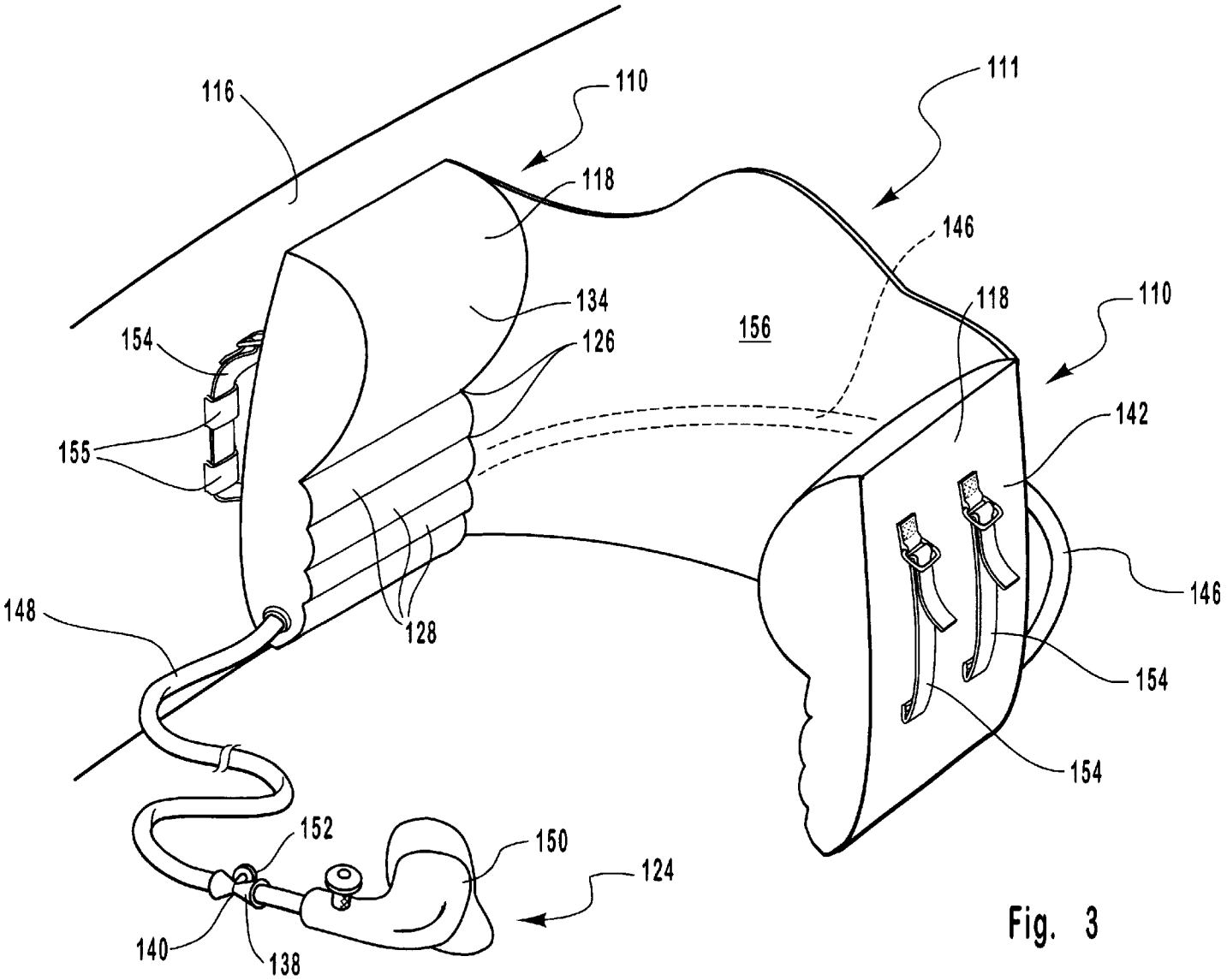
FIG. 3 is a perspective view of an alternative embodiment of a hip grip an attached mouth pump.

Referring now to FIG. 3, an alternative embodiment of a hip grip 110 is presented. The hip grip 110, is provided with an inflator 124 for infusing an inflation material such as air into the bladders 118. The inflator has a mouth piece 150 which is connected to the,bladders 118 by an inflation tube 148. A user can inflate the bladders 118 by blowing air into the mouthpiece. A retention valve 138 is located on the inflation tube 148 for retaining the air within the bladders 118. The retention valve 138 can be a clamp 152 which is tightened around the inflation tube 148. In this configuration, the retention valve 138 also serves as the release valve 140. The clamp 152 is loosened to allow air to escape from the bladders 118.

The air inflated bladders 118 with a mouth piece 150 can also serve as a life saving device for a boater. A boater can capsize the boat 14 and become trapped in debris under water. In such situations an additional amount of air can allow the boater to free himself from the boat 14 or be rescued. Thus, the boater can insert the mouthpiece 150 into his mouth and release the air from the bladders 118 for breathing.

As discussed above the bladders 118 are attached to the inside wall 116 of the cockpit 12 by fasteners. The fasteners can be tethers 154. The tethers 154 can be sewn or otherwise to the sleeve 142. The tethers 154 1are threaded though slots 155 within the wall 116 of the cockpit 12. The tethers 154 are tightened to hold the hip grip 110 in place.

The hip grip system 110 may also include a back pad 156. The back pad 156 may be secured to the hip grips 110, to provide a seat 111 which can be inserted into the cockpit 12. The back pad 156 will add additional padding and make a boater more comfortable when seated in the boat 14. The seat cushion 44 of FIG. 2 and the back pad 156 may be used separately or jointly in forming a seat 11, 111. As discussed above, the attachment of the seat 11, 111 to the boat 14 can give the boater greater control over his boat 14 by transferring the movements of the boater to the boat 14.

Figure 4:
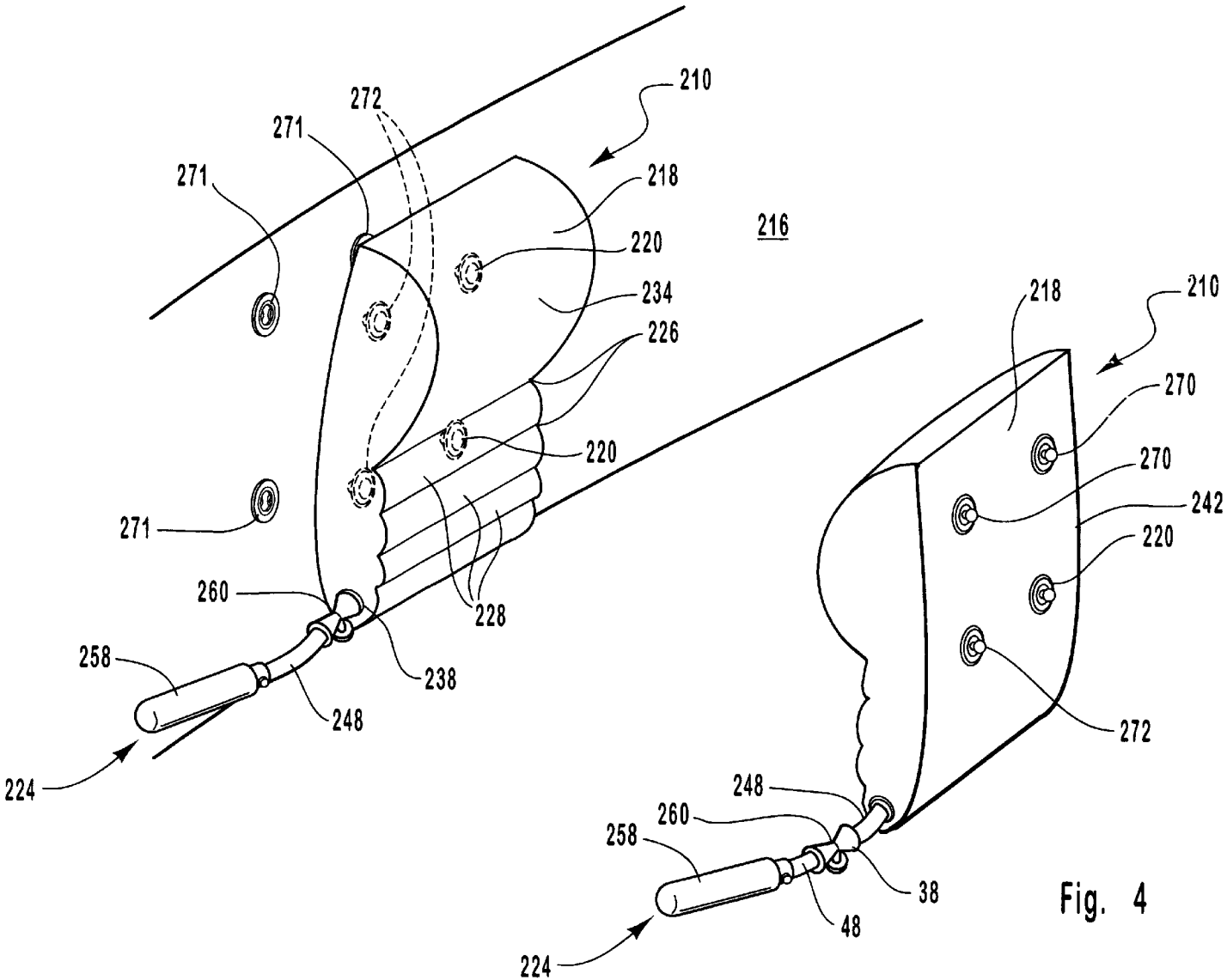
FIG. 4 is a perspective view of a further embodiment of the hip grip of the present invention illustrating an attached compressed air pump.

Referring now to FIG. 4, a hip grip system 210 is shown with an alternative inflator 224. The inflator 224 has a vessel 258 of compressed gas such as carbon dioxide. The vessel can be attached to an inflation tube 248. The gas is released from the vessel 258 and flows through the inflation tube 248 into the bladders 218. A retention valve 238 prevents the back flow of the carbon dioxide. Such a retention valve 238 can be a one way valve 260.

An alternative fastener 220 is also shown in FIG. 4. A set of snaps 270 can be used to secure the hip grip 210 within the cockpit 12. A first portion 271 of a snap 270 is attached to the cockpit wall 216. The complementary second portion 272 of the snap 270 is attached to the sleeve 242. The hip grip 210 can then be inserted into the cockpit 12 and the snaps 270 fastened.

Figure 5:
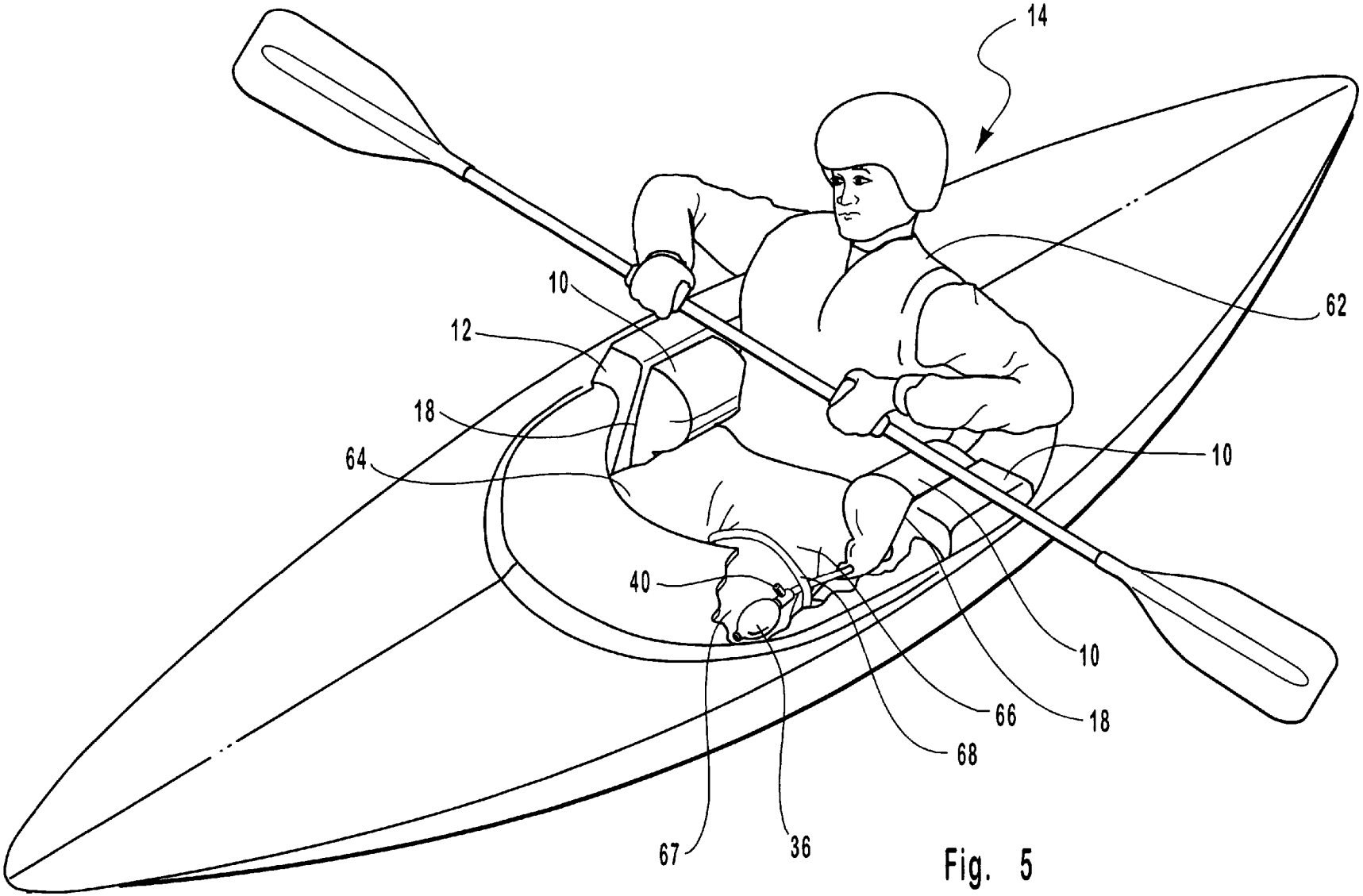
FIG. 5 is a perspective view of one embodiment of the hip grip of the present invention illustrating an inflator secured to the thigh of a user.

Referring now to FIG. 5, a complete hip grip system 10 is shown inserted into the cockpit 12 of a boat 14. A seat cushion 44 is attached to the hip grip system 10 and secured to the seat of the boat. A user 62 is seated within the cockpit 12 on the seat cushion 44. The inflatable bladders 18 are inflated around the hip portion 67 of the user 62 and connect the user 62 to the boat 14.

The hip grip system 10 is shown with an inflation tube 48 which run from the bladders 18 to the thigh 66 of the user 62. A hand pump 36 or other inflator 24 can be attached at a distal end 49 of the inflation tube 48. Because the inflator 24 is located somewhat distantly from the inflatable bladders 18, the user 62 can readily access the inflator 42 while seated within the cockpit 12. While seated, the user 62 can activate the inflator 24 and inflate the bladders 18 creating a custom fitted hip grip 10. Moreover, the amount of inflation material in the bladders 18 can be changed while the user 62 is seated within the cockpit 12. More air is forced into the bladders 18 by depressing the hand pump 36. Air can be removed from the bladders 18 by releasing the release valve 40.

The cockpit 12 is covered by a skirt 64 which helps to keep the user 62 dry and prevent the boat 14 from filling with water. The skirt 64 is positioned over the lower portion of the user's body. Thus, the user's thighs 66 and knees 67 are covered by the skirt. Because a portion or all of the hip grip 10 may be covered by the skirt 64, the inflator 24 can also be covered by the skirt 64 making it difficult for the user 62 to add or release inflation material from the bladders 18. The inflator 24 can be attached to the thigh 66 or knee 67 of the user 62 by a fastener 68. With the inflator 24 attached to the thigh 66 or knee 67, the inflator can be activated by pressing down upon the skirt 64 over the pump 36. Alternatively the inflator 24 can be directly attached to the skirt 64, and the inflator 24 activated by pressing the knee 67 or thigh 64 of the user 62 against the inflator 24.

This hip grip system 10 is readily adjustable to the preferences multiple users. The bladders 18 can be inflated while the user 62 is seated within the cockpit 12. The inflation material can be released from the bladders 18, and the bladders inflated again to fit another user. Additionally, the hip grip system 10 can also be adjusted to accommodate the changing preferences of an individual user 62 by adding or releasing inflation material from the bladders 18. The hip grip system 10 can be inflated with a gas, liquid, or a gel all of which may reduce the discomfort associated with conventional hip grip systems.

We claim:

1. An inflatable hip grip for insertion into a cockpit of a boat, the inflatable hip grip comprising:

an inflatable bladder configured to be positioned adjacent an interior side of the cockpit of the boat; and an inflator in fluid communication with the bladder, the bladder configured to be inflated by the infusion of an inflation material into the bladder by the inflator, the inflated bladder exerting a pressure on the hip portion of a user when the user is seated within the cockpit of the boat.

2. The inflatable hip grip of claim 1, further comprising a retention valve for retaining the inflation material within the bladder.

3. The inflatable hip grip of claim 1, wherein the inflator is a hand pump.

4. The inflatable hip grip of claim 1, further comprising a release valve fluidly connected to the bladder for releasing the inflation material from the bladder.

5. The inflatable hip grip of claim 1, further comprising an inflation tube configured to be attached to the bladder such that the inflator can infuse the inflation material into the bladder while positioned at a distance from the bladder.

6. The inflatable hip grip of claim 5, wherein the inflator is configured to be secured to the thigh portion of the user.

7. The inflatable hip grip of claim 5, wherein the boat comprises a skirt for covering a lower body portion of the user, the inflator positioned relative to the skirt so that inflation material is infused into the bladder by the user pressing on the skirt.

8. The inflatable hip grip of claim 1, wherein the inflation material is selected from the group consisting of a gas, a liquid, and a gel.

9. The inflatable hip grip of claim 8, wherein the gas is air.

10. The inflatable hip grip of claim 9, wherein the air contained within the bladder is available to be used as secondary air for a boater trapped under water.

11. The inflatable hip grip of claim 10, further comprising an inflatable baffle in fluid communication with the bladder.

12. The inflatable hip grip of claim 9, wherein the inflator comprises a mouthpiece configured to be connected to the bladder, the bladder being inflated as the user blows air into the mouthpiece.

13. The inflatable hip grip of claim 1, wherein the inflator comprises a vessel of compressed gas.

14. The inflatable hip grip of claim 1, wherein the inflation material has a density less than the density of water so that the bladder serves as flotation for the boat.

15. The inflatable hip grip of claim 1, further comprising a fastener for securing the bladder to the cockpit of the boat.

16. The inflatable hip grip of claim 15, wherein the fastener is selected from the group consisting of hook and loop fabric, an adhesive, a snap, tape, a tether, a zipper, a screw, a bolt, a brad, and a rivet.

17. The inflatable hip grip of claim 1, wherein the inflatable bladder comprises one or more channels for receiving the inflation material, the channels configured to provide a larger chamber for receiving the inflation material near a top of the bladder and a smaller chamber near a bottom of the bladder.

18. The inflatable hip grip of claim 1, further comprising a sleeve configured to be placed over the inflatable bladder.

19. The inflatable hip grip of claim 1, wherein the bladder is attached to a seat cushion.

20. The inflatable hip grip of claim 1, wherein the bladder is in fluid communication with an inflatable back cushion.

21. The inflatable hip grip of claim 1, further comprising an inflatable knee grip in fluid communication with the bladder.

22. An inflatable hip grip for insertion into a cockpit of a boat, the inflatable hip grip comprising:

an inflatable bladder configured to be positioned adjacent an interior side of the cockpit of the boat;

an inflator in fluid communication with the bladder, the bladder configured to be inflated by the infusion of an inflation material into the bladder by the inflator, the inflated bladder exerting a pressure on the hip portion of a user when the user is seated within the cockpit of a boat;

a retention valve for retaining the inflation material within the bladder; and a fastener for securing the bladder to the cockpit of the boat.

23. The inflatable hip grip of claim 22, further comprising a second inflatable bladder.

24. The inflatable hip grip of claim 23, wherein the bladders are in fluid communication with each other.

25. The inflatable hip grip of claim 23, wherein the bladders are fluidly isolated from each other.

26. The inflatable hip grip of claim 22, wherein the boat comprises a skirt for covering a lower body portion of the user, the inflator configured to be inflated by the user pressing down on the skirt.

27. The inflatable hip grip of claim 22, wherein the inflation material is air.

28. The inflatable hip grip of claim 27, wherein the air contained within the bladder is available to be used as secondary air for a boater trapped under water.

29. A boat seat configured to be placed within a cockpit of a boat, the seat comprising:

an inflatable hip grip comprising an inflatable bladder configured to be positioned adjacent an interior side the cockpit of the boat, an inflator in fluid communication with the bladder, the bladder configured to be inflated by the infusion of an inflation material into the bladder by the inflator, the inflated bladder exerting a pressure on the hip portion of a user when the user is seated within the cockpit of the boat, and a retention valve for retaining the inflation material within the bladder;

a cushion attached to the hip grip; and a fastener for securing the seat to the cockpit of the boat.

30. The boat seat of claim 29, further comprising a release valve for releasing the inflation material from the bladder.

31. The boat seat of claim 29, the inflatable hip grip further comprising an inflation tube configured to be attached to the bladder such that the inflator can inflate the bladder positioned at a distance from the bladder.

32. The boat seat of claim 29, wherein the boat comprises a skirt for covering the lower body portion of the user, the inflator configured to be inflated by the user pressing down on the skirt.

33. The boat seat of claim 29, wherein the inflation material is air, and the air contained in the bladder is available to be used as secondary air for a boater trapped under water.

34. The boat seat of claim 29, wherein the inflation material has a density less than the density of water to add buoyancy to the boat.

35. The boat seat of claim 29, wherein the inflatable bladder comprises one or more channels for receiving the inflation material, the channels configured to provide a larger chamber for receiving the inflation material near a top of the bladder and a smaller chamber near a bottom of the bladder.

36. The boat seat of claim 29, wherein the cushion is configured to pad the back of the user.

37. The boat seat of claim 29, wherein the cushion is configured to pad the posterior of the user.

38. An inflatable hip grip for insertion into a cockpit of a boat, the inflatable hip grip comprising:

an inflatable bladder configured to be positioned adjacent an interior side of the cockpit of the boat, the inflatable bladder comprising one or more channels, the channels configured to provide a larger inflatable chamber near a top of the bladder and a smaller inflatable chamber near a bottom of the bladder; and an inflator in fluid communication with the bladder, the bladder configured to be inflated by the infusion of an inflation material into the bladder by the inflator, the inflated bladder exerting a pressure on the hip portion of a user when the user is seated within the cockpit of the boat.

39. The inflatable hip grip of claim 38, further comprising a retention valve for retaining the inflation material within the bladder.

40. The inflatable hip grip of claim 38, wherein the inflator is a hand pump.

41. The inflatable hip grip of claim 38, further comprising a release valve fluidly connected to the bladder for releasing the inflation material from the bladder.

42. The inflatable hip grip of claim 38 further comprising an inflation tube configured to be attached to the bladder such that the inflator can infuse the inflation material into the bladder while positioned at a distance from the bladder.

43. The inflatable hip grip of claim 42, wherein the inflator is configured to be secured to the thigh portion of the user.

44. The inflatable hip grip of claim 42, wherein the boat comprises a skirt for covering a lower body portion of the user, the inflator positioned relative to the skirt so that inflation material is infused into the bladder by the user pressing on the skirt.

45. The inflatable hip grip of claim 38, wherein the inflation material is selected from the group consisting of a gas, a liquid, and a gel.

46. The inflatable hip grip of claim 45, wherein the gas is air.

47. The inflatable hip grip of claim 46, wherein the air contained within the bladder is available to be used as secondary air for a boater trapped under water.

48. The inflatable hip grip of claim 47, further comprising an inflatable baffle in fluid communication with the bladder.

49. The inflatable hip grip of claim 46, wherein the inflator comprises a mouthpiece configured to be connected to the bladder, the bladder being inflated as the user blows air into the mouthpiece.

50. The inflatable hip grip of claim 38, wherein the inflator comprises a vessel of compressed gas.

51. The inflatable hip grip of claim 38, wherein the inflation material has a density less than the density of water so that the bladder serves as flotation for the boat.

52. The inflatable hip grip of claim 38, further comprising a fastener for securing the bladder to the cockpit of the boat.

53. The inflatable hip grip of claim 52, wherein the fastener is selected from the group consisting of hook and loop fabric, an adhesive, a snap, tape, a tether, a zipper, a screw, a bolt, a brad, and a rivet.

54. The inflatable hip grip of claim 38, further comprising a sleeve configured to be placed over the inflatable bladder.

55. The inflatable hip grip of claim 38, wherein the bladder is attached to a seat cushion.

56. The inflatable hip grip of claim 38, wherein the bladder is in fluid communication with an inflatable back cushion.

57. The inflatable hip grip of claim 38, further comprising an inflatable knee grip in fluid communication with the bladder.

58. A boat seat configured to be placed within a cockpit of a boat, the seat comprising:

an inflatable hip grip comprising an inflatable bladder configured to be positioned adjacent an interior side the cockpit of the boat, an inflator in fluid communication with the bladder, the bladder configured to be inflated by the infusion of an inflation material into the bladder by the inflator, the inflatable bladder comprising one or more channels for receiving the inflation material, the channels configured to provide a larger chamber for receiving the inflation material near a top of the bladder and a smaller chamber near a bottom of the bladder, the inflated bladder exerting a pressure on the hip portion of a user when the user is seated within the cockpit of the boat, and a retention valve for retaining the inflation material within the bladder;

a cushion attached to the hip grip; and a fastener for securing the seat to the cockpit of the boat.

59. The boat seat of claim 58, further comprising a release valve for releasing the inflation material from the bladder.

60. The boat seat of claim 58, the inflatable hip grip further comprising an inflation tube configured to be attached to the bladder such that the inflator can inflate the bladder positioned at a distance from the bladder.

61. The boat seat of claim 58, wherein the boat comprises a skirt for covering the lower body portion of the user, the inflator configured to be inflated by the user pressing down on the skirt.

62. The boat seat of claim 58, wherein the inflation material is air, and the air contained in the bladder is available to be used as secondary air for a boater trapped under water.

63. The boat seat of claim 58, wherein the inflation material has a density less than the density of water to add buoyancy to the boat.

64. The boat seat of claim 58, wherein the cushion is configured to pad the back of the user.

65. The boat seat of claim 58, wherein the cushion is configured to pad the posterior of the user.

* * * * *